United States Patent [19]

Olson et al.

[11] Patent Number: 4,835,011

[45] Date of Patent: May 30, 1989

[54] YTTRIUM ENRICHED ALUMINIDE COATINGS

[75] Inventors: Walter E. Olson; Dinesh K. Gupta, both of Vernon; Michael S. Milaniak, Middlefield, all of Conn.

[73] Assignee: United Technologies Corporation, Hartford, Conn.

[21] Appl. No.: 926,166

[22] Filed: Nov. 3, 1986

[51] Int. Cl.[4] ..... C23C 10/48

[52] U.S. Cl. ..... 427/253; 75/253

[58] Field of Search ..... 75/253; 427/253; 428/652, 678

[56] References Cited

U.S. PATENT DOCUMENTS

| | | | |
|---|---|---|---|
| Re. 26,001 | 4/1966 | Wachtell et al. | 29/183.5 |
| 2,801,187 | 7/1957 | Galniche | 117/50 |
| 3,625,750 | 12/1971 | Baranow et al. | 117/107.2 |
| 3,779,719 | 12/1973 | Clark | 428/678 |
| 3,794,511 | 2/1974 | Baranow | 117/22 |
| 3,993,454 | 11/1976 | Giggins, Jr. et al. | 29/194 |
| 3,996,021 | 12/1976 | Chang et al. | 29/194 |
| 4,123,595 | 10/1978 | Chang | 428/667 |
| 4,156,042 | 5/1979 | Hayman et al. | 427/253 |

FOREIGN PATENT DOCUMENTS

| | | | |
|---|---|---|---|
| 55-82769 | 6/1980 | Japan . | |
| 0115945 | 9/1980 | Japan | 428/652 |
| 740861 | 6/1980 | U.S.S.R. . | |

*Primary Examiner*—Sam Silverberg

*Attorney, Agent, or Firm*—James M. Rashid

[57] ABSTRACT

Methods are described for forming an yttrium enriched aluminide coating on the surface of a nickel or cobalt base superalloy article. In one preferred embodiment, a pack mixture for forming the coating consists essentially of, by weight percent, 5–35 of an Al-Y-Si alloy, 1–20 $CoI_2$, balance $Y_2O_3$.

8 Claims, 1 Drawing Sheet

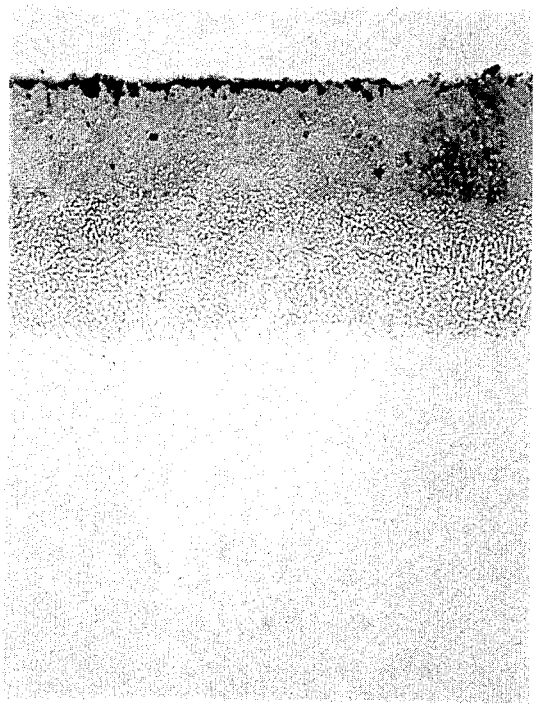
0.001in
(0.025mm)

YTTRIUM ENRICHED ALUMINIDE COATINGS

TECHNICAL FIELD

This invention pertains to diffusion aluminide coatings. In particular, it pertains to diffusion aluminide coatings which contain yttrium.

BACKGROUND

Aluminide coatings are widely used in the gas turbine engine industry to provide protection against oxidation and corrosion degradation to superalloy articles used in the engine. U.S. Patents which are indicative of the skill in the art relative to aluminide coatings include the following: U.S. Pat. Nos. 3,079,276, 3,276,903, 3,667,985, 3,801,353, 3,837,901, 3,958,047, 4,132,816, 4,142,023, 4,148,275 and 4,332,843. In general, aluminide coatings are formed by heating a powder mixture containing a source of aluminum, an activator, and an inert diluent in the presence of the article to be coated. The article may either be embedded in the powder mixture (and the process is termed a "pack cementation" process) or the article is in out-of-contact relation with the powder mixture (and the process is termed a "gas phase" process).

The source of aluminum may be pure aluminum metal or it may be an alloy of aluminum such as $Co_2Al_5$, as disclosed in U.S. Pat. No. 4,132,816 to Benden et al; U.S. Pat. No. 3,958,047 to Baldi discloses the use of $Ni_3Al$ as the source of aluminum; and U.S. Pat. No. 4,332,843 to Ahuja discloses the use of $Fe_2Al_5$. Activators which have been used in the aluminiding process generally include halides of alkali or alkaline earth metals. See, e.g., the aforementioned patent to Benden. Aluminum oxide is typically added to the powder mixture as a buffer or diluent, in order to control the aluminum activity of the mixture. There are also references in the prior art that aluminum oxide prevents the powder mixture from sintering together during the coating process. See, e.g., U.S. Pat. No. 3,667,985 to Levine et al.

U.S. Pat. No. 3,794,511 to Baranow discloes that a nickel alloy having an aluminide coating which contains Misch metal has better resistance to sulfidation degradation than the same alloy with an aluminide coating containing no Misch metal. The coatings are produced by heating the article in an aluminum-Misch metal alloy powder, the alloy containing between 27 and 45 weight percent aluminum.

In U.S. Pat. No. 3,996,021 to Chang et al, a small amount of hafnium is added to a powder mixture containing an Al-Ti-C alloy, an activator such as $NH_4F$, and aluminum oxide. The powder mixture is said to produce an aluminide coating containing between 0.1 and 10 weight percent hafnium.

U.S. Pat. No. 3,993,454 to Giggins et al suggests that coatings which contain hafnium have better high temperature properties (e.g., resistance to oxidation and corrosion) than do coatings containing yttrium.

Other patents which relate to diffusion coatings include U.S. Pat. Nos. 2,801,187, 3,625,750, 4,123,595 and 4,156,042; U.S. Pat. No. Reissue 26,001; and Japanese Patent No. 55-82769.

Notwithstanding the developments in aluminide coatings, engineers still expend considerable effort in an attempt to develop coatings having improved properties.

SUMMARY OF THE INVENTION

In accordance with this invention, an yttrium enriched diffusion aluminide coating containing about 20–35 weight percent aluminum and about 0.2–2.0 weight percent yttrium is deposited on a nickel or cobalt base superalloy article. This coating has high temperature properties which are far superior to the diffusion coatings of the prior art. The invention coating is produced by heating the article in the present of (i.e., embedded in or in out-of-contact relation with) a powder mixture which contains an alloy or mixture of aluminum, yttrium, and one or more of the elements from the group of silicon, chromium, cobalt, titanium, and nickel; a halide containing activator; and an inert material which is not reduced by yttrium containing vapors evolved during the deposition process. Preferably, the aluminum and yttrium are alloyed with each other and with a third constituent "X" which is one or more of the aforementioned elements silicon, chromium, cobalt, nickel, and titanium. X is more preferably silicon, chromium, or cobalt, and is most preferably silicon. The halide in the activator is preferably in iodide, and the most preferably activator to use with an aluminum-yttrium-silicon powder mixture is cobalt iodide. The filler material which is used is preferably yttrium oxide.

A coating 0.001 to 0.0035 inches thick is formed on nickel base superalloys with a 1,800°–2,000° F., 4–20 hour coating cycle. In addition to containing 20–35% Al and 0.2–2.0% Y, the coating also contains elements from the base material, in amounts similar to prior art (yttrium free) aluminide coatings. The invention coatings have about 300% better oxidation life compared to prior art aluminide coatings which do not contain yttrium.

BRIEF DESCRIPTION OF THE DRAWING

The Figure is a photomicrograph of an yttrium enriched aluminide coating produced in accordance with this invention.

BEST MODE FOR CARRYING OUT THE INVENTION

The invention can be carried out using diffusion coating techniques known to those skilled in the art. For a representative example of such techniques, see commonly assigned U.S. Pat. Nos. 3,544,348 to Boone et al and 4,132,816 to Benden et al, both of which are incorporated by reference.

The aluminiding powder mixture comprises at least three parts. The first part is a metallic alloy or mixture containing aluminum, yttrium, and a third constituent designated "X", where X is one or a combination of the elements selected from the group consisting of silicon, chromium, cobalt, nickel, and titanium. The firs part of the aluminiding powder mixture is preferably an alloy (rather than a mixture of elemental powders), and this alloy is referred to as an aluminum-yttrium-X alloy. Three aluminum-yttrium-X alloys are especially preferred in the practice of this invention. They are aluminum-yttrium-silicon (Al-Y-Si), aluminum-yttrium-chromium (Al-Y-Cr), and aluminum-yttrium-cobalt (Al-Y-Co). The most preferred alloy is Al-Y-Si.

The composition of the aluminum-yttrium-X alloy should be about, by weight percent, 2–20 yttrium, 6–50 X, balance aluminum. A more preferred range is 2–12 yttrium, 8–48 X, balance aluminum. When X is chromium or cobalt, the preferred range is 30–44 chromium or cobalt, 2–12 yttrium, balance aluminum. When X is silicon, the preferred range is 6–20 silicon, 2–12 yttrium, balance aluminum. This particular range of alloys has a melting point slightly less than pure aluminum.

The second part of the powder mixture is an activator which reacts with the aluminum and yttrium containing powder during the high temperature coating process to produce aluminum and yttrium containing vapors which are carried to the article surface which is to be coated. Preferably, the activator is a halide of any of the transition metals. The most preferred halide is iodide, and the most preferred transition metal halide is cobalt iodide, $CoI_2$. The use of the preferred activator $CoI_2$ ensures that, in general, yttrium diffuses into the coating simultaneously with aluminum, and that the yttrium is evenly distributed throughout the coating. While halide containing activators based on alkali or alkaline earth metals may also be used, the results obtained with $CoI_2$ are clearly superior.

The third part of the powder mixture is an inert filler material which controls the activity of the aluminum and yttrium containing powder mixture, and also prevents the mixture from sintering together during the coating cycle. The filler metal used in this invention must have particular properties, due to the characteristics of the metallic Al-Y-X alloy. Due to the highly reactive nature of the yttrium containing vapors which are produced when the powder mixture is heated, the filler metal must not react with these vapors. In other words, the filler metal must not be reduced by yttrium, otherwise little or no yttrium will diffuse into the article being coated. Aluminum oxide, the filler metal used throughout the coating industry in prior art diffusion aluminide coating powder mixtures, will be reduced by yttrium if used in the invention method and form the more stable yttrium oxide; therefore aluminum oxide is not useful in the practice of this invention. Yttrium oxide will not be reduced in the invention method, and is therefore the preferred filler metal. Other possible filler materials are material more stable than yttrium oxide (i.e., nonreactive with yttrium).

The composition of the preferred powder mixture (i.e., aluminum and yttrium containing alloy, activator, and filler) is about, by weight percent, 5–35 aluminum-yttrium-X, where X is one or more of the elements selected from silicon, chromium, cobalt, nickel, and titanium; 1–20 of a halide activator; with the balance a filler material which is not reduced by yttrium at the elevated coating deposition temperature. Preferably, the mixture is 5–35 Al-Y-Si, 1–20 $CoI_2$, balance $Y_2O_3$. Most preferably, the mixture is 5–10 Al-Y-Si, 5–10 $CoI_2$, balance $Y_2O_3$.

The invention may be better understood by reference to the following examples, which are intended to illustrate the features of the invention. In each example, the nickel base superalloy test specimens which were coated had the composition describe in commonly assigned U.S. Pat. No. 4,209,348 to Duhl et al.

EXAMPLE I

A coating pack mixture which contained, by weight percent, 5 Al-Y-Si, 10 $CoI_2$, balance $Y_2O_3$ was prepared. The composition of the Al-Y-Si alloy was about 77Al - 11Y - 12 Si, and was in powder form, having an average particle size of about 10–40 microns. The $CoI_2$ activator was an anhydrous powder and the $Y_2O_3$ particle size was nominally about 25 microns. The powder mixture was thoroughly mixed and then the test specimens and pack mixture placed in a protective gas atmosphere (i.e., nonoxidizing) retort. After heating the retort to about 1,900° F. for 16 hours, an yttrium enriched aluminide coating having a thickness of about 0.002–0.0025 inches was produced, and had a microstructure similar to that shown in the Figure. In cyclic burner rig oxidation tests at 2,100° F., the coating had a life of about 255 hours per mil.

EXAMPLE II

Test specimens were coated in the manner described in Example I with a pack mixture which contained 5 Al-Y-Si, 5 $CoI_2$, balance $Y_2O_3$. The Al-Y-Si alloy was the same as described in Example I. The 0.003 inch thick coating which was produced had a life of about 300 hours per mil in a 2,100° F. cyclic oxidation test.

EXAMPLE III

Techniques similar to those described in the aforementioned U.S. Pat. No. 3,544,348 were used to apply a prior art (i.e., yttrium free) aluminide coating. The coating produced with these prior art techniques was about 0.002–0,003 inches thick, and had a life of about 90 hours per mil in 2,100° F. cyclic oxidation tests.

Thus, in comparison with the oxidation resistance of the coatings described in Example I and Ii, the invention coatings have about 300% better resistance to oxidation degradation than do the coatings of the prior art.

EXAMPLE IV

A coating according to this invention was produced by heating a powder mixture containing 10 Al-Y-Cr, 5 $CoI_2$, balance $Y_2O_3$ at 1,900° F. for 6 hours. The Al-Y-Cr alloy composition was about 60Al - 38Cr - 2Y. A 0.002–0.0025 inch yttrium enriched coating was produced, which had a 2,100° F. cyclic oxidation test life of about 180 hours per mil, which is about 200% better than the prior art aluminide coatings.

EXAMPLE V

Test specimens were pack aluminided at 1,900° F. for 6 hours in a powder mixture containing 20 Al-Y-Cr, 10 $CoI_2$, balance $Y_2O_3$. The composition of the Al-Y-Cr alloy was about 60Al - 34Cr- 6Y. The resultant 0.002–0.0025 inch yttrium enriched aluminide coating had a 2,100° F. cyclic oxidation life of about 195 hours per mil.

EXAMPLE VI

Test specimens were pack aluminided at 1,900° F. for 6 hours in a powder mixture which contained 50 Al-Y-Co, 5$CoI_2$, balance $Y_2O_3$. The composition of the Al-Y-Co alloy was about 56Al - 6Y - 40Co. The resultant 0.0025–0.003 inch yttrium enriched aluminide coating had a 2,100° F. cyclic oxidation life of about 140 hours per mil. This low life (compared with the lives of the invention coatings in the above examples) is due to the high metallic content (50%) in the pack mix. The high metallic content results in the diffusion of an excessive amount (i.e., greater than about 2%) of yttrium in the coating, which reduces the coating's melting point, and thereby its oxidation resistance. Preferably, the invention coatings contain a maximum of about 0.5% yttrium, most preferably about 0.3%.

EXAMPLE VII

Test specimens were pack aluminide coated in a powder mixture which contained 15% of a nickel-yttrium alloy, 1.5% $NH_4F$, balance $Al_2O_3$. After heating at about 2,000° F. for 4 hours, a 0.002 inch thick aluminide coating was formed. Chemical analysis of the coating indicated that it contained no yttrium. During the coating process, yttrium containing vapors apparently reacted first with the $Al_2O_3$ filler material, and reduced the $Al_2O_3$ to the more stable $Y_2O_3$. As a result, no yttrium diffused into the test specimen. Cyclic oxidation testing at 2,100° F. indicated that the coating performed similarly to the yttrium free coatings of Example III.

From the foregoing description, one skilled in the art can ascertain the essential features of this invention, and can make various changes and modifications of the invention to adapt it to various uses and conditions, without departing from its spirit or scope. For example, slurry or gas phase coating techniques may be used in place of pack techniques, as disclosed in, e.g., U.S. Pat. No. 4,374,183 to Deadmore et al and 4,132,816 to Benden et al, respectively. Furthermore, any of the other rare earth elements may be present in combination with, or substituted for, yttrium provided that an appropriate inert buffer is selected and the necessary process changes made (which can readily be determined by one skilled in the art). See, e.g., the following U. S. Patents, the contents of which are incorporated by reference: U.S. Pat. Nos. 3,542,530; 3,918,139; 3,928,026; 3,993,454; 4,034,142; 4,535,033; and Re. 32,121.

We claim:

1. A method for forming an yttrium enriched diffusion aluminide coating on a nickel or cobalt base superalloy article, comprising the step of heating the article to an elevated temperature in the presence of a powder mixture consisting essentially of an aluminum-yttrium-X alloy, a halide activator, and yttrium oxide filler material, wherein X is selected from the group consisting of silicon, chromium, cobalt, nickel, titanium, and hafnium, or is an alloy or mixture thereof.

2. The method of claim 1, wherein X is silicon, chromium, or cobalt.

3. The method of claim 2, wherein X is silicon.

4. The method of claim 1, wherein the halide activator is cobalt iodide.

5. A method for forming an yttrium enriched diffusion aluminide coating on a nickel or cobalt base superalloy article, comprising the step of disposing the article in a pack mixture consisting essentially of, by weight percent, 5–10 Al-Y-Si, 5–10 $CoI_2$, balance $Y_2O_3$, wherein the Al-Y-Si alloy contains 2–12 Y, 8–15 Si, balance Al; and heating the mixture at conditions sufficient to produce a 0.001 to 0.0035 inch thick coating.

6. The method of claim 5, wherein the Al-Y-Si alloy contains about 11 Y, 12 Si, balance Al.

7. A method for forming an yttrium enriched diffusion aluminide coating on a nickel or cobalt base superalloy article, comprising the step of disposing the article in a retort in out-of-contact relation with a pack mixture in the retort, the pack mixture consisting essentially of, by weight percent, 5–10 Al-Y-Si, 5-10 $CoI_2$, balance $Y_2O_3$, wherein the Al-Y-Si alloy contains 2-12 Y, 8–15 Si, balance Al; and heating the retort at conditions sufficient to produce a 0.001 to 0.0035 inch thick coating.

8. A method for forming an yttrium enriched diffusion aluminide coating on a nickel or cobalt base superalloy article, comprising the step of heating the article in a powder mixture consisting essentially of an Al-Y-Si alloy, $CoI_2$ activator, and $Y_2O_3$ filler material, to cause diffusion of aluminum and yttrium into the article surface.

* * * * *

UNITED STATES PATENT AND TRADEMARK OFFICE

CERTIFICATE OF CORRECTION

PATENT NO. : 4,835,011

DATED : May 30, 1989

INVENTOR(S) : Walter E. Olson, Dinesh K. Gupta, Michael S. Milaniak

It is certified that error appears in the above-identified patent and that said Letters Patent is hereby corrected as shown below:

column 2, line 10, "present" should be --presence-- column 2, line 23, "in" should be --an--. (2nd occurrence)

Signed and Sealed this

Twenty-second Day of May, 1990

*Attest:*

HARRY F. MANBECK, JR.

*Attesting Officer*

*Commissioner of Patents and Trademarks*